US010377140B2

(12) United States Patent
Sahara et al.

(10) Patent No.: US 10,377,140 B2
(45) Date of Patent: Aug. 13, 2019

(54) PRINTING APPARATUS, METHOD OF CONTROLLING SAME, AND NON-TRANSITORY COMPUTER-READABLE STORAGE MEDIUM

(71) Applicant: CANON KABUSHIKI KAISHA, Tokyo (JP)

(72) Inventors: Akiyoshi Sahara, Funabashi (JP); Toshiyuki Kuroda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/658,820

(22) Filed: Jul. 25, 2017

(65) Prior Publication Data

US 2018/0029372 A1 Feb. 1, 2018

(30) Foreign Application Priority Data

Aug. 1, 2016 (JP) ..... 2016-151521

(51) Int. Cl.
*B41J 2/165* (2006.01)

(52) U.S. Cl.
CPC ..... *B41J 2/16579* (2013.01); *B41J 2/16508* (2013.01); *B41J 2/16517* (2013.01); *B41J 2/16538* (2013.01); *B41J 2002/16573* (2013.01)

(58) Field of Classification Search
CPC ..... B41J 2/16579; B41J 2/16508; B41J 2/16538; B41J 2/16517
See application file for complete search history.

(56) References Cited

U.S. PATENT DOCUMENTS

| | | | |
|---|---|---|---|
| 6,984,018 | B2 | 1/2006 | Uetsuki et al. |
| 9,446,595 | B2 | 9/2016 | Takarabe et al. |
| 9,597,875 | B2 | 3/2017 | Aoyama et al. |
| 2002/0126308 | A1 | 9/2002 | Uetsuki et al. |

FOREIGN PATENT DOCUMENTS

| | | |
|---|---|---|
| JP | 2002-248780 A | 9/2002 |
| JP | 2008-205616 A | 9/2008 |

*Primary Examiner* — Kristal Feggins
(74) *Attorney, Agent, or Firm* — Venable LLP

(57) ABSTRACT

A printing apparatus comprises: a maintenance unit that performs a maintenance operation for a printhead that includes a plurality of operation patterns; a storage unit that stores information indicating which of the operation patterns was performed when the maintenance operation was performed; a timer that measures an elapsed time from a previous printing operation; a determination unit that determines whether or not to execute the maintenance operation; and a control unit that controls the operation patterns of the maintenance operation to be performed in accordance with the elapsed time and the information, wherein in a case where a scanning instruction is received and the determination unit determines to execute the maintenance operation, the control unit performs control for executing the maintenance operation not in accordance with the elapsed time but in accordance with the information before the operation of scanning.

13 Claims, 8 Drawing Sheets

PRINTING APPARATUS, METHOD OF CONTROLLING SAME, AND NON-TRANSITORY COMPUTER-READABLE STORAGE MEDIUM

BACKGROUND OF THE INVENTION

Field of the Invention

The present invention relates to a printing apparatus, a method of controlling the same, and a non-transitory computer-readable storage medium.

Description of the Related Art

Japanese Patent Laid-Open No. 2008-205616 recites, in a printing apparatus, performing capping as a maintenance operation for a printhead in advance, before an image scanning operation. By the technique of Japanese Patent Laid-Open No. 2008-205616, a maintenance operation of the printhead automatically activating in the middle of an image scanning operation is suppressed, and a disorder in a scanned image due to vibration in accordance with the maintenance operation is prevented.

In addition, Japanese Patent Laid-Open No. 2002-248780 recites, in a printing apparatus, temporary capping of a printhead is performed in a case where a wait period during which a printing operation is not performed exceeds a first predetermined period. Subsequently, when a second predetermined period is exceeded, the capping is performed again after performing a printhead wiping operation. By the technique of Japanese Patent Laid-Open No. 2002-248780, the frequency of a maintenance operation of the printhead is reduced, the life span of the printhead and the maintenance operation mechanism is lengthened, and the period from when a printing image is input into the printing apparatus to when a printing operation is started is shortened.

However, when attempting to achieve both the reduction of the frequency of the maintenance operation of the printhead in accordance with Japanese Patent Laid-Open No. 2002-248780 and the suppression of automatic activation of the maintenance operation of the printhead during an image scanning operation in accordance with Japanese Patent Laid-Open No. 2008-205616, a new problem arises. Specifically, to cause both execution and suppression of periodic maintenance operations to be performed, it is necessary to control the maintenance operation based on the timing at which the maintenance operation is executed and the details of a maintenance operation that is already being performed, considering the influence on the image scanning operation.

SUMMARY OF THE INVENTION

In consideration of the problem described above, the present invention enables appropriate control of execution and suppression of a periodic maintenance operation, with consideration of an influence on an image scanning operation.

According to one aspect of the present invention, there is provided a printing apparatus comprising: a scanning unit configured to perform an operation of scanning an original document based on a scanning instruction; a printhead configured to perform a printing operation; a maintenance unit configured to perform a maintenance operation for the printhead that includes a plurality of operation patterns; a storage unit configured to store information indicating which of the operation patterns was performed when the maintenance operation was performed; a timer configured to measure an elapsed time from a previous printing operation; a determination unit configured to determine whether or not to execute the maintenance operation; and a control unit configured to control the operation patterns of the maintenance operation to be performed in accordance with the elapsed time and the information, wherein, in a case where the scanning instruction is received and the determination unit determines to execute the maintenance operation, the control unit performs control for executing the maintenance operation not in accordance with the elapsed time but in accordance with the information before the operation of scanning by the scanning unit.

According to another aspect of the present invention, there is provided a method of controlling a printing apparatus provided with a scanning unit for performing an operation of scanning an original document based on a scanning instruction, and a printhead for performing a printing operation, the method comprising: performing a maintenance operation for the printhead that includes a plurality of operation patterns; storing information indicating which of the operation patterns was performed when the maintenance operation was performed; measuring an elapsed time from a previous printing operation; determining whether or not to execute the maintenance operation; and controlling the operation patterns of the maintenance operation to be performed in accordance with the elapsed time and the information, wherein, in a case where the scanning instruction is received and it is determined to execute the maintenance operation, control for executing the maintenance operation is performed not in accordance with the elapsed time but in accordance with the information before the operation of scanning by the scanning unit.

According to another aspect of the present invention, there is provided a non-transitory computer readable medium storing a program for causing a computer provided with a scanning unit for performing an operation of scanning an original document based on a scanning instruction, and a printhead for performing a printing operation to function as a maintenance unit configured to perform a maintenance operation for the printhead that includes a plurality of operation patterns; a storage unit configured to store information indicating which of the operation patterns was performed when the maintenance operation was performed; a timer configured to measure an elapsed time from a previous printing operation; a determination unit configured to determine whether or not to execute the maintenance operation; and a control unit configured to control the operation patterns of the maintenance operation to be performed in accordance with the elapsed time and the information, wherein, in a case where the scanning instruction is received and the determination unit determines to execute the maintenance operation, the control unit performs control for executing the maintenance operation not in accordance with the elapsed time but in accordance with the information before the operation of scanning by the scanning unit.

The present invention provides a printing apparatus that can appropriately control execution and suppression of a periodic maintenance operation in consideration of an influence on an image scanning operation.

Further features of the present invention will become apparent from the following description of exemplary embodiments (with reference to the attached drawings).

DESCRIPTION OF THE EMBODIMENTS

<First Embodiment>

With reference to the drawings, explanation is given below regarding the first embodiment of the present invention.

[Apparatus Configuration]

Figure 1:
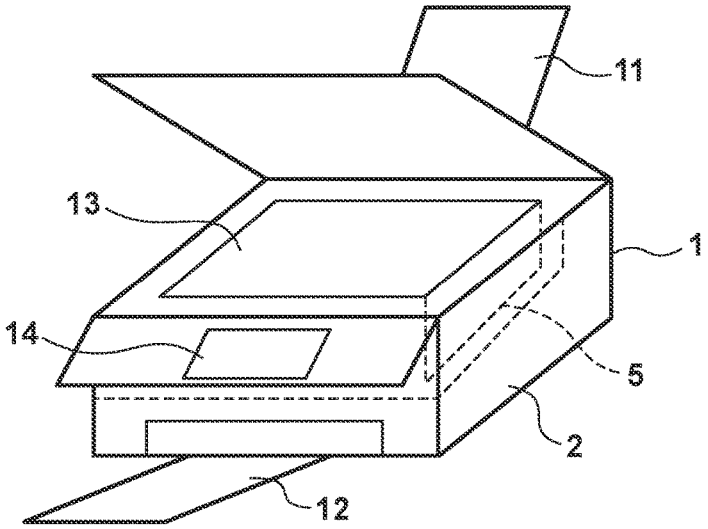
FIG. 1 is an external perspective view of a printing apparatus according to the present application invention.

FIG. 1 is an external perspective view of a printing apparatus according to the present embodiment. A printing apparatus 1 is provided with an ink-jet printing unit 2, a flatbed scanning unit 5, and an operation display unit 14. The printing unit 2 is fed one sheet at a time with a printing medium (hereinafter referred to as a print paper) such as paper that is stacked on a feed tray 11, performs a printing operation, and discharges to a discharge tray 12. The scanning unit 5 scans an image of an original that is placed on an original platen 13. By performing a predetermined operation via the operation display unit 14, a user can perform a copy function for printing an image of the original placed on the original platen 13 to a print paper, and a setting or instruction for a print function in accordance with a printing operation. Note that the scanning unit 5 is assumed to be a flatbed type, but may also be an auto document feed (ADF: Auto Document Feeder) type instead. In addition, it may combine the flatbed type and the ADF type.

Figure 2:
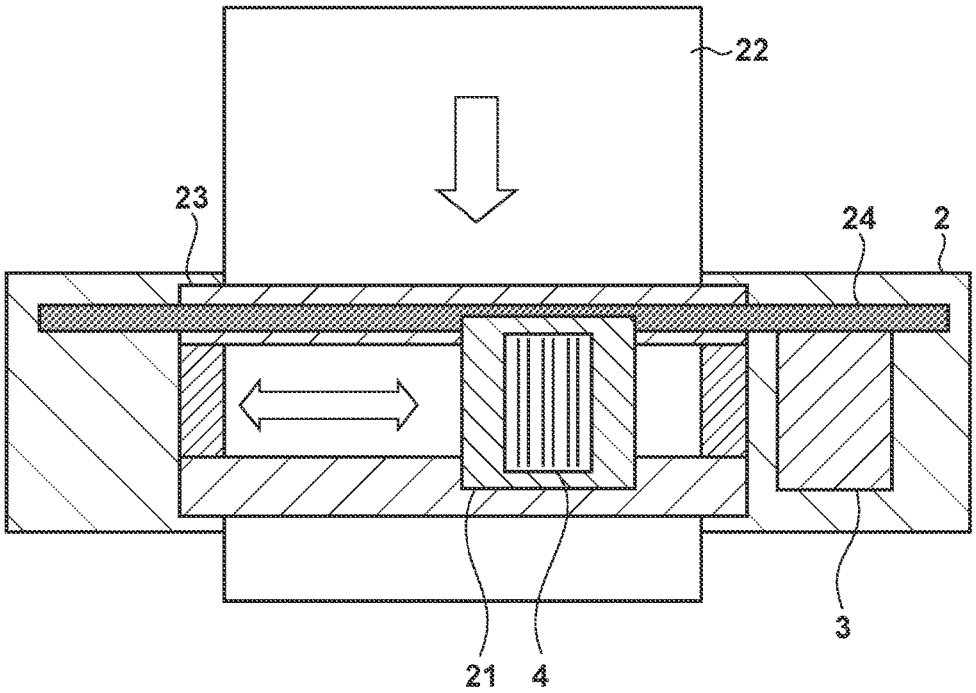
FIG. 2 is a view illustrating an example of a configuration of a printing unit of the printing apparatus according to the present application invention.

FIG. 2 is a view that schematically illustrates a positional relationship of the printing unit 2 from the perspective of the top surface of a print paper, in the printing apparatus 1. Printing to a print paper 22 is performed by causing a carriage 21 equipped with a printhead 4 to move back and forth along a printing guide 24, discharging ink that is a print agent from the printhead 4, and conveying the print paper 22 by a conveyance roller 23. In addition, a maintenance operation of the printhead 4 is performed by causing the carriage 21 to move along the printing guide 24 to a position opposite a purge unit 3, and then causing the purge unit 3 to operate. Note that the configuration of the printing unit 2 is not limited to that illustrated in FIG. 2, and may be a configuration in which a printhead for the width of a printing medium is used, for example. Note that, although no particular limitation is made here, configuration may such that the printhead is equipped with an ink cartridge (not shown) of a monochrome or any of a plurality of colors.

Figure 3:
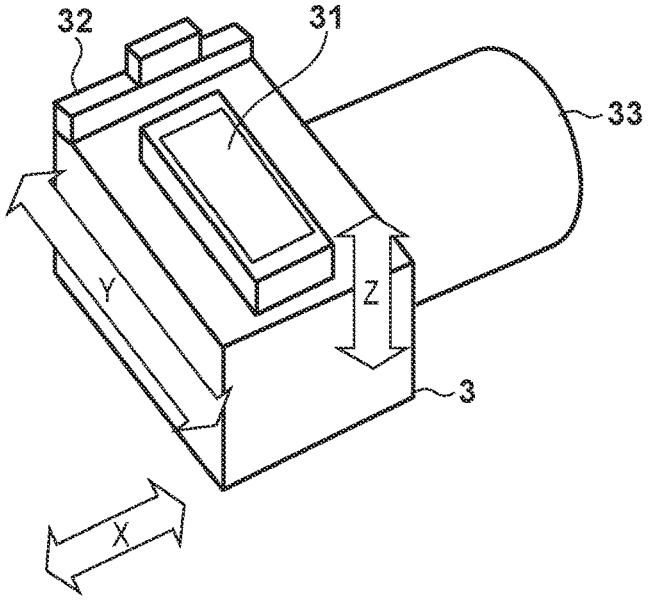
FIG. 3 is a view illustrating an example of a configuration of a purge unit of the printing apparatus according to the present application invention.

FIG. 3 is a view that schematically illustrates constituent members of the purge unit 3. An X direction illustrated in FIG. 3 corresponds to a horizontal direction (a main scanning direction) of FIG. 2, and a Y direction of FIG. 3 corresponds to a longitudinal direction (a sub scanning direction) of FIG. 2. The purge unit 3 is provided with a cap 31 and a wiper 32. The cap 31 can move up and down in a Z direction of FIG. 3. Capping the printhead 4 by lifting the cap 31 in a state in which it is opposite the printhead 4 when not doing a printing operation, (a capping operation), suppresses moisture evaporation from a discharge orifice of the printhead 4. Here, a state where capping has been performed by the cap 31 is given as a "closed state", and a state in which capping is not performed is given as an "open state". An operation for setting the closed state may be referred to as a cap close operation, and an operating for setting the open state may be referred to as a cap open operation. In addition, the cap 31 can temporarily receive ink that is preliminarily discharged from the printhead 4. By operating a purge pump 33 to perform idle suction in a state where the printhead 4 is not capped, it is possible to recover ink received by the cap 31 in a wasted ink recovery body (not shown).

In contrast, the wiper 32 can move back and forth in a Y direction of FIG. 3. By moving the wiper 32 (wiping) in a state where a discharge orifice surface of the printhead 4 and the wiper 32 are in contact, ink that has attached to the discharge orifice surface is wiped. This operation is referred to as a wiping operation.

Figure 4:
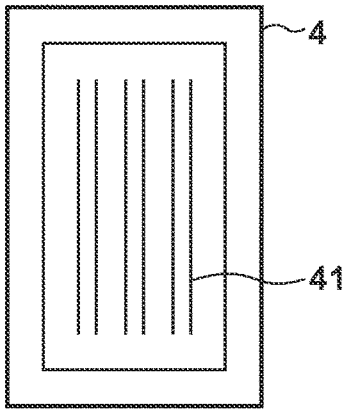
FIG. 4 is a view illustrating an example of a configuration of a printhead according to the present application invention.

FIG. 4 is a view that schematically illustrates a discharge orifice surface of the printhead 4. On the discharge orifice surface of the printhead 4, a plurality of discharge orifice arrays 41 that comprise a plurality of discharge orifices are formed, and ink is discharged from each of these discharge orifices.

Figure 5:
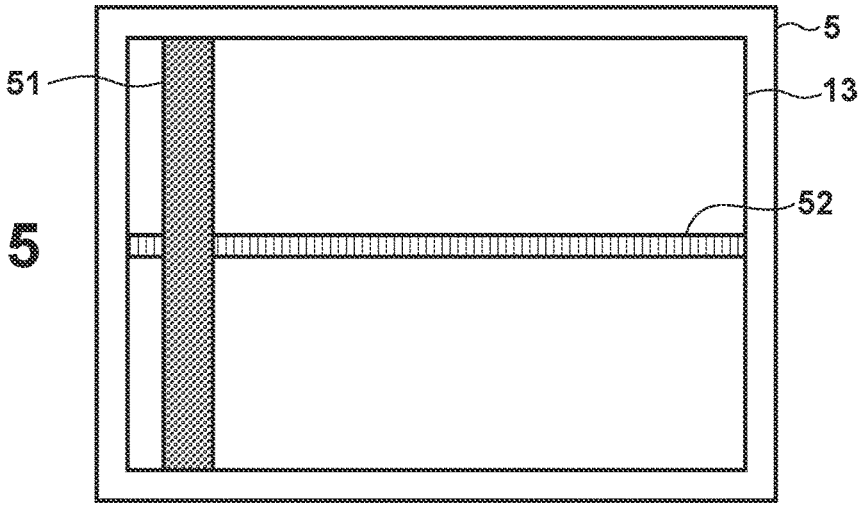
FIG. 5 is a view illustrating an example of a configuration of a scanning unit according to the present application invention.

FIG. 5 is a view that schematically illustrates a positional relationship of the scanning unit 5 from the perspective of the top surface of the original platen 13. By moving a scanning sensor unit 51 along a scanning guide 52 (left and right directions in FIG. 5), an image is scanned from an original by a scanning sensor (not shown) on the scanning sensor unit 51. In the present embodiment, a configuration in which a contact image sensor (CIS: Contact Image Sensor) is provided as the scanning sensor is used, but a charge-coupled device (CCD: Charge Coupled Device) may be used.

Figure 6:
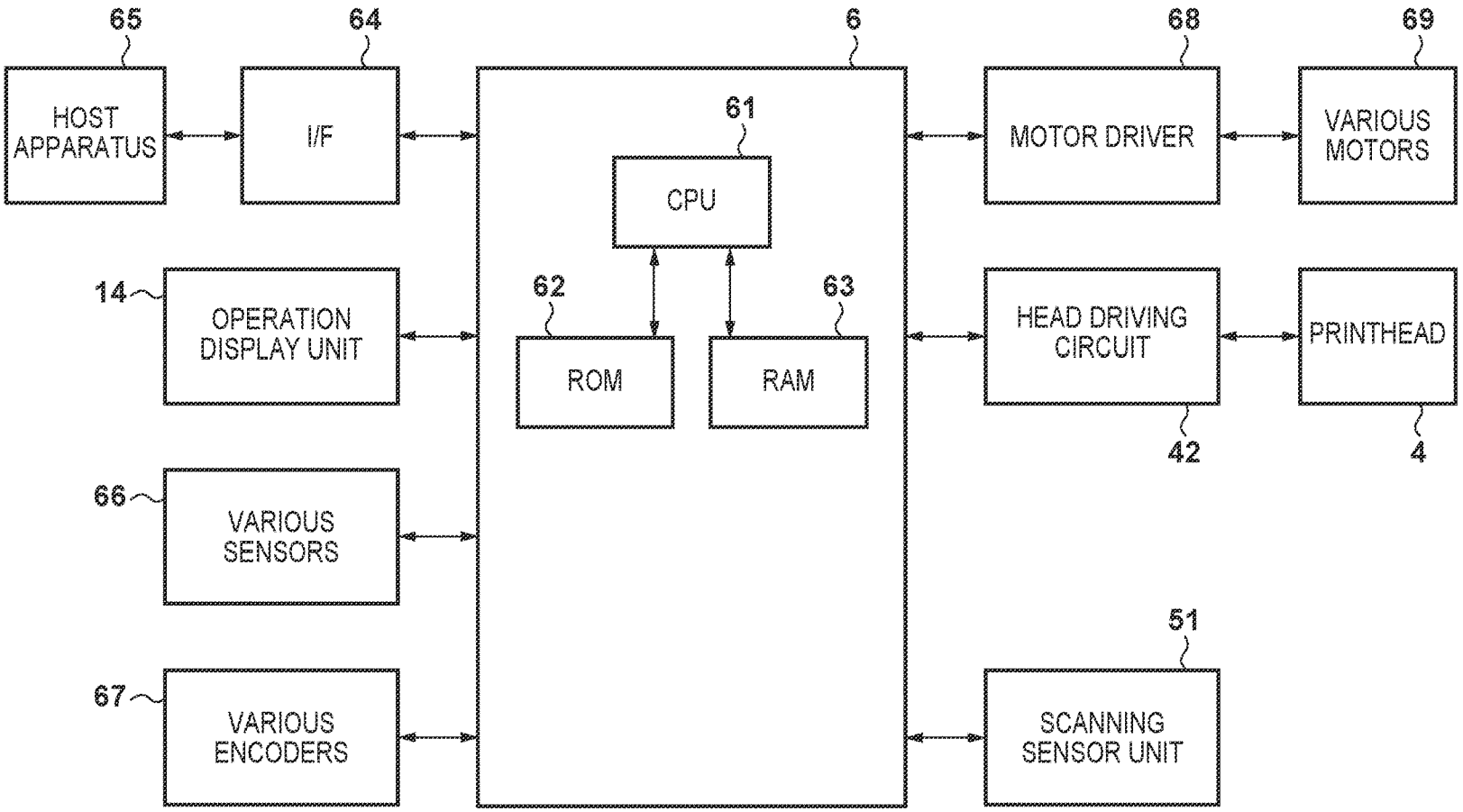
FIG. 6 is a view illustrating an example of a system configuration of the printing apparatus according to the present application invention.

FIG. 6 is a view that illustrates an example of a system configuration in the printing apparatus 1 according to the present embodiment. A control unit 6 is configured by including a CPU 61 that is responsible for control, a RAM 63 that stores temporary data at a time of control, and a ROM 62 that stores a control program. The control unit 6 is communicably connected to a host apparatus 65 such as a PC, via an I/F (interface) 64. The control unit 6 receives from the host apparatus 65 image data to be printed by the printing unit 2. In addition, the control unit 6 sends image data read by the scanning unit 5 to the host apparatus 65. The operation display unit 14 is connected to the control unit 6. The control unit 6 accepts, via the operation display unit 14, a user operation such as an instruction for a copy operation. In addition, a copy function setting or the like is displayed via the operation display unit 14.

In addition, various sensors 66, various encoders 67, a motor driver 68, a head driving circuit 42, and the scanning sensor unit 51 are connected to the control unit 6. The control unit 6 can obtain a sensor signal based on a result detected by the various sensors 66. In addition, the control unit 6 can detect a position or the like of the scanning sensor unit 51 or the carriage 21, in accordance with an output from the various encoders 67. In addition, by outputting an instruction to the motor driver 68, the control unit 6 drives various motors 69 to cause the carriage 21, the cap 31, the wiper 32, the purge pump 33, the scanning sensor unit 51, and the like to operate. The control unit 6 causes discharge of ink from the printhead 4 by outputting an instruction to the head driving circuit 42. The control unit 6 outputs an instruction to the scanning sensor unit 51, and receives an image signal inputted to the scanning sensor unit 51.

The control unit 6 controls a printing operation and preliminary discharge by a combination of driving of the various motors 69 and ink discharge from the printhead 4. In addition, the control unit 6 controls a scanning operation by driving of the various motors 69 and the scanning sensor unit 51.

Note that, in the present embodiment, an idle suction operation by the purge pump 33 is explained as being capable of operation at two stages of intensity, the stronger one being an intensity S, and the weaker one being an intensity W. It is assumed that an operation period is longer for an idle suction operation in accordance with the intensity S than an idle suction operation in accordance with the intensity W.

[Operational Flow]

Explanation is given below regarding operation of the printing apparatus 1 according to the present embodiment. In the present embodiment, each processing flow is realized by the CPU 61 of the printing apparatus 1 reading a program provided in the ROM 62 into the RAM 63, and executing it.

(Maintenance Operation)

Figure 7A:
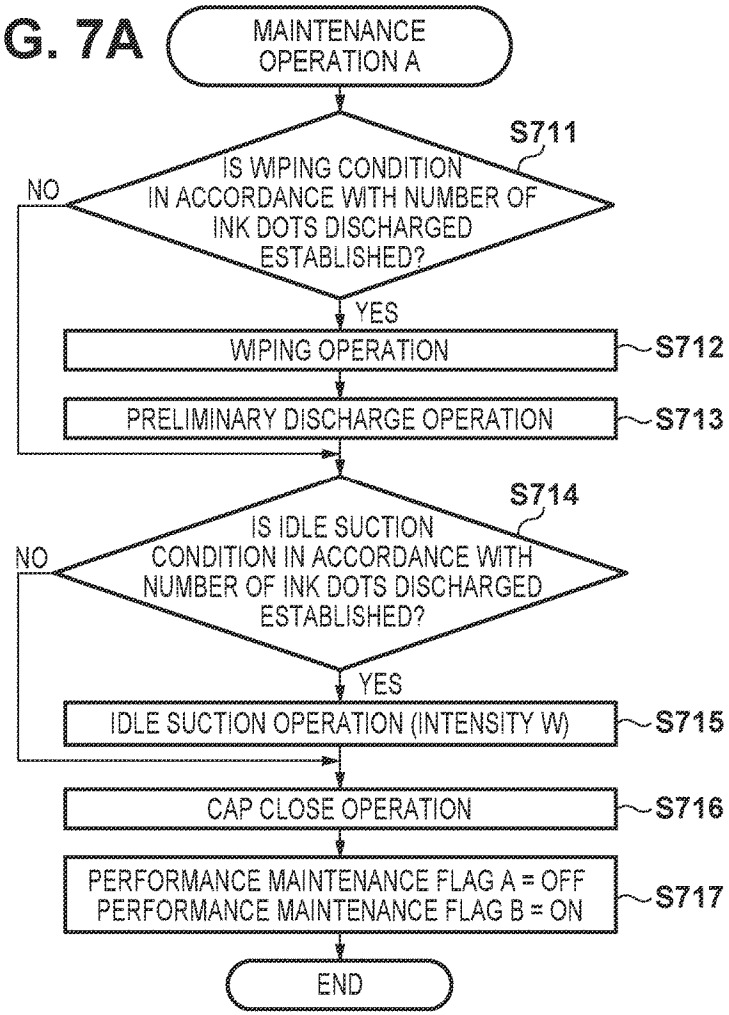
FIGS. 7A, 7B and 7C are flowcharts illustrating control according to each maintenance operation.
Figure 7B:
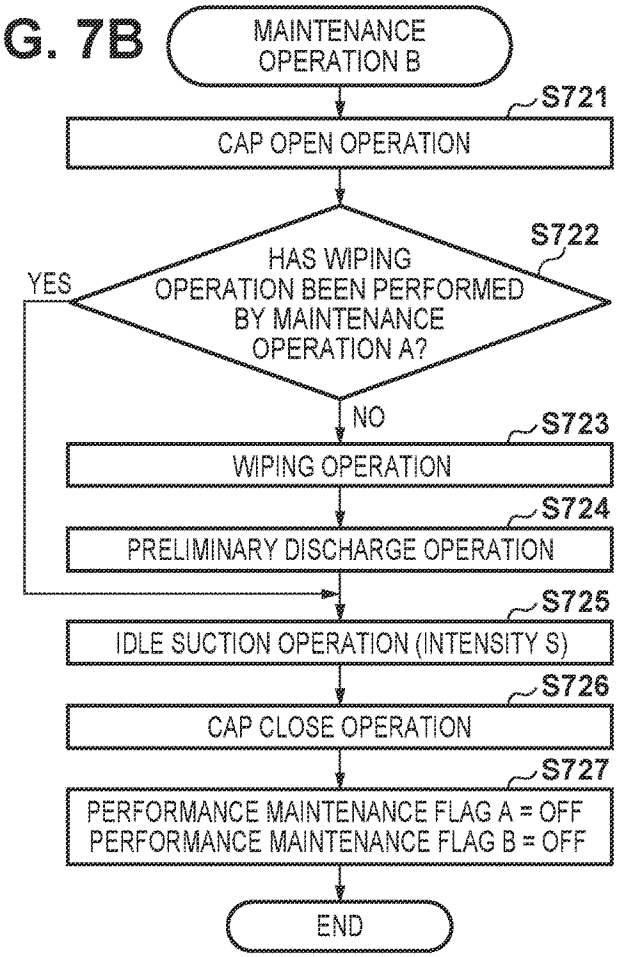
Figure 7C:
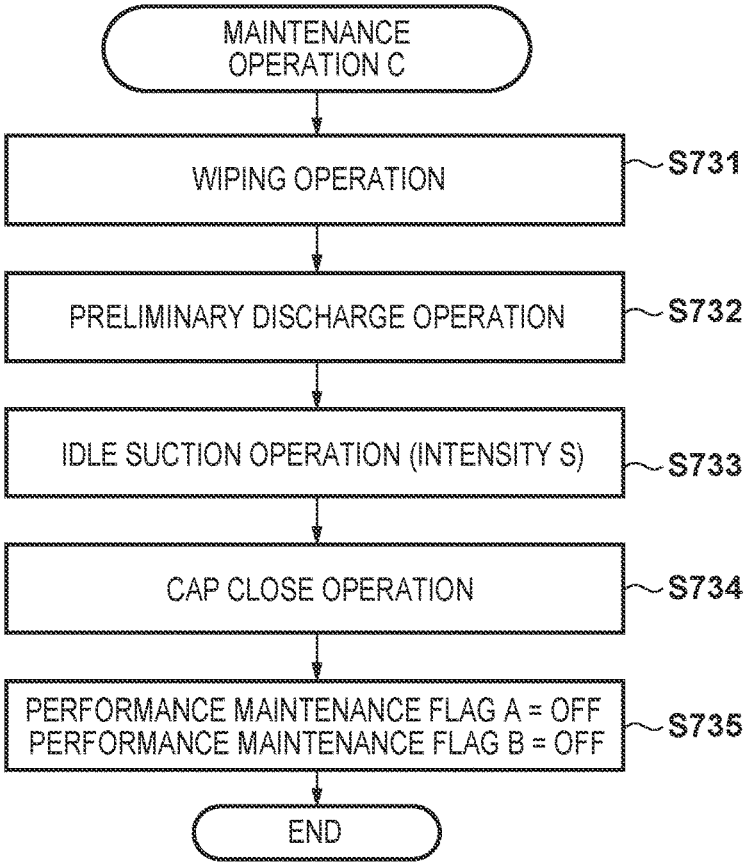

FIGS. 7A, 7B and 7C are flowcharts illustrating control of a maintenance operation of the printhead 4 in accordance with the purge unit 3. A maintenance operation in the present embodiment is an operation that is performed to maintain print quality of the printing apparatus 1, and specifically includes, for example, an idle suction operation, a preliminary discharge operation, and wiping or capping with respect to the printhead 4. Here, it is assumed that three operation patterns are used as a maintenance operation, and operations therefor are respectively illustrated by the three flowcharts of FIGS. 7A, 7B and 7C. Here, each is referred to as "maintenance operation A", "maintenance operation B", and "maintenance operation C".

In each operation pattern, it is assumed that operations to be executed are different. For example, maintenance operation C always performs a wiping operation, a preliminary discharge operation, an idle suction operation, and a cap close operation, and furthermore has the highest effect as a maintenance operation because the idle suction operation is performed at the intensity S. In contrast, for maintenance operation A, because each operation is performed in accordance with whether a predetermined condition is satisfied, an operation that is always performed is only the cap close operation.

FIG. 7A is a flowchart that illustrates maintenance operation A. Maintenance operation A is an operation for performing minimum necessary performance maintenance of the printhead 4 after a printing operation has ended.

In step S711, the CPU 61 determines whether a wiping operation is necessary in accordance with a number of ink dots discharged from the printhead 4. In the present embodiment, it is assumed that the printing apparatus 1 is provided with a measurement unit (not shown) that counts as appropriate a number of ink dots that are discharged, and that a value measured by the measurement unit is held in the RAM 63. Note that this measurement unit may be realized by the CPU 61. For example, if, after the performance of a previous wiping operation, a number of ink dots due to a preliminary discharge operation and a printing operation is greater than or equal to "threshold P", a wiping operation is determined to be necessary. Here, it is assumed that threshold P is defined in advance as a predetermined number, and is stored in the ROM 62 or the like. A reason to determine in accordance with the number of ink dots is that the more that ink is discharged, the easier it is for ink to attach to the discharge orifice surface, and the greater the necessity to wipe the ink becomes. If a wiping operation is determined to be unnecessary (NO in step S711) the processing proceeds to step S714, and if a wiping operation is determined to be necessary (YES in step S711) the processing proceeds to step S712.

In step S712, the CPU 61, by driving the various motors 69 via the motor driver 68, causes a wiping operation by the wiper 32 to be performed. Subsequently the processing proceeds to step S713.

In step S713, the CPU 61 causes a preliminary discharge operation for the printhead 4 to be performed. Here, the preliminary discharge operation is performed to resolve mixed color due to the wiping operation. Consequently, in a case where mixed color due to a wiping operation is not likely to occur, the preliminary discharge operation does not need to be performed in step S713. Subsequently the processing proceeds to step S714.

In step S714, the CPU 61 determines whether an idle suction operation is necessary in accordance with a number of ink dots discharged from the printhead 4. For example, if, after the performance of a previous idle suction operation, a number of ink dots due to a preliminary discharge to the cap 31 is greater than or equal to "threshold Q", an idle suction operation is determined to be necessary. Here, it is assumed that threshold Q is defined in advance as a predetermined number, and is stored in the ROM 62 or the like. A reason for determining in accordance with a number of ink dots that were preliminary discharged is because the more that preliminary discharging is performed, the more that ink received by the cap 31 increases, and the greater the need for wasted ink recovery becomes. If an idle suction operation is determined to be unnecessary (NO in step S714) the processing proceeds to step S716, and if an idle suction operation is determined to be necessary (YES in step S714) the processing proceeds to step S715.

In step S715, the CPU 61, by driving the various motors 69 via the motor driver 68, causes an idle suction operation by the purge pump 33 to be performed. The intensity of the idle suction operation is set to "intensity W" here.

In step S716, the CPU 61, by driving the various motors 69 via the motor driver 68, performs a cap close operation to have the cap 31 enter the "closed state".

In step S717, the CPU 61 changes the value of two flags that express a necessity of a maintenance operation of the printhead 4: "performance maintenance flag A" and "performance maintenance flag B". Here, the value of performance maintenance flag A being "ON" indicates that a maintenance operation has not been performed after a printing operation ends, and in this case expresses that a maintenance operation is necessary. Meanwhile, the value of performance maintenance flag B being "ON" indicates that maintenance operation A has been performed after a printing operation ended, and that only the minimum necessary maintenance operation has been performed. In addition, the performance maintenance flag A and performance maintenance flag B both being off "OFF" indicates that a sufficient maintenance operation has been performed after a printing operation ends, and in this case expresses that a maintenance operation is unnecessary. In this step, the value of performance maintenance flag A is set to OFF, and the value of performance maintenance flag B is set to ON. By this, only the minimum maintenance operation that is necessary is performed. This processing flow then ends.

FIG. 7B is a flowchart that illustrates maintenance operation B. Maintenance operation B is an operation for performing sufficient performance maintenance that is not excessive or insufficient, from a state where the minimum necessary maintenance operation of the printhead 4 has been performed by maintenance operation A.

In step S721, the CPU 61 performs a cap open operation by driving the various motors 69 via the motor driver 68. In other words, a state in which it is possible to perform a wiping operation or an idle suction operation without obstruction is achieved by putting the cap 31 in the "open state" from the "closed state" by maintenance operation A.

In step S722, the CPU 61 determines whether a wiping operation was performed in advance by maintenance operation A. If a wiping operation is determined to have been performed in advance (YES in step S722) the processing proceeds to step S725, and if a wiping operation is determined to have not been performed (NO in step S722) the processing proceeds to step S723.

In step S723, the CPU 61, by driving the various motors 69 via the motor driver 68, causes a wiping operation by the wiper 32 to be performed. Subsequently the processing proceeds to step S724.

In step S724, a preliminary discharge operation is caused to be performed.

In step S725, the CPU 61, by driving the various motors 69 via the motor driver 68, causes an idle suction operation by the purge pump 33 to be performed. The intensity of the idle suction operation here is such that it is performed at the strong intensity S rather than the intensity W. Note that, in FIG. 7B, an idle suction operation is performed while the cap 31 is in the "open state", but the process may be configured to perform the idle suction operation while the cap 31 is in the "closed state", and subsequently perform a cap open operation to put the cap 31 in the "open state".

In step S726, the CPU 61, by driving the various motors 69 via the motor driver 68, performs a cap close operation to have the cap 31 enter the "closed state".

In step S727, the CPU 61 sets the values of both of performance maintenance flag A and performance maintenance flag B to OFF. By this, a maintenance operation becomes unnecessary. This processing flow then ends.

FIG. 7C is a flowchart that illustrates maintenance operation C. Maintenance operation C is an operation for performing sufficient performance maintenance from a state where a maintenance operation has not been performed after a printing operation ends.

In step S731, the CPU 61, by driving the various motors 69 via the motor driver 68, causes a wiping operation by the wiper 32 to be performed.

In step S732, the CPU 61 causes a preliminary discharge operation for the printhead 4 to be performed.

In step S733, the CPU 61, by driving the various motors 69 via the motor driver 68, causes an idle suction operation by the purge pump 33 to be performed. The intensity of the idle suction operation is set to "intensity S" here.

In step S734, the CPU 61, by driving the various motors 69 via the motor driver 68, performs a cap close operation to have the cap 31 enter the "closed state".

In step S735, the CPU 61 sets the values of both of performance maintenance flag A and performance maintenance flag B to OFF. This indicates that a maintenance operation is unnecessary. This processing flow the ends.

(Processing after Printing Operation Ends)

Figure 8:
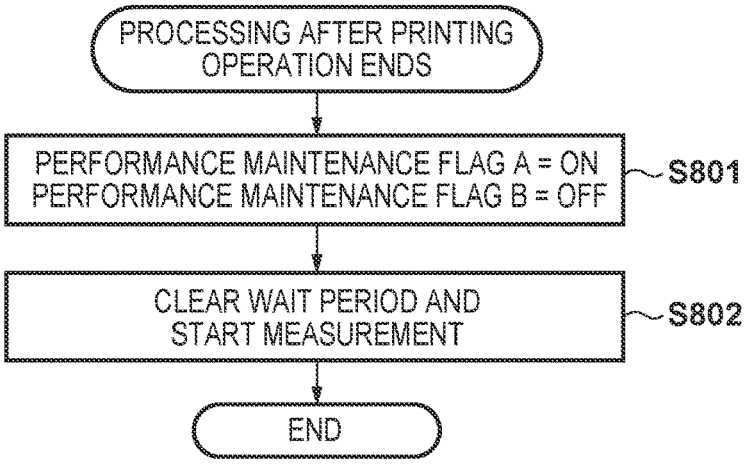
FIG. 8 is a flowchart illustrating a process after a printing operation ends.

FIG. 8 is a flowchart that indicates processing to perform after a printing operation ends. It is started by the printing unit 2 when a printing operation has ended. Note that the end of a printing operation here may be when one job that corresponds to a printing operation has ended, or may be when all jobs are complete in a case where a plurality of jobs are consecutive. Alternatively, this processing may also be started when a predetermined period has elapsed from when a printing operation with respect to a job has completed.

In step S801, the CPU 61 changes the values of performance maintenance flag A and performance maintenance flag B. In this step, the value of performance maintenance flag A is set to ON, and the value of performance maintenance flag B is set to OFF. By this, that a state where a maintenance operation for the printhead 4 is necessary has been entered is indicated.

In step S802, the CPU 61 starts measurement of an elapsed time (a wait period) from when a printing operation ends. The wait period here expresses an elapsed period in which a printing operation is not performed from when a printing operation ends. The wait period is set to "0" at a time when a printing operation has ended, and timekeeping continues until a printing operation is performed again. Note that the printing apparatus 1 is provided with a timekeeping means (not shown), and uses it to measure an elapsed time. This processing flow then ends.

(Processing to Decide a Maintenance Operation Based on the Wait Period)

Figure 9:
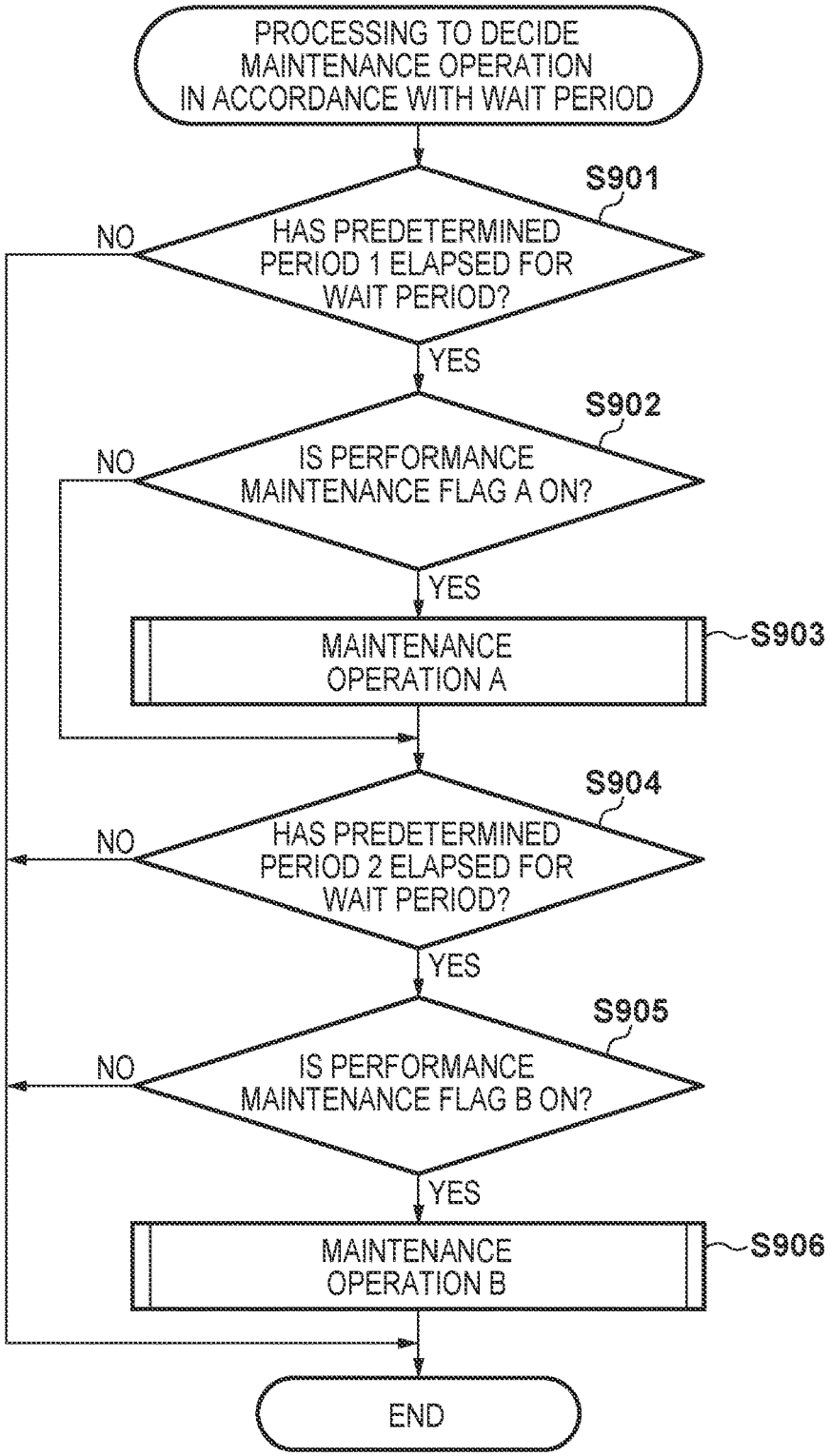
FIG. 9 is a flowchart illustrating a maintenance operation decision based on a wait period.

FIG. 9 is a flowchart that illustrates control for deciding and performing a maintenance operation for the printhead 4 by the purge unit 3 in accordance with the elapsed time (a wait period) from when a printing operation by the printing unit 2 has ended. This flowchart is assumed to be performed periodically, and is performed every 100 milliseconds, for example. Note that, a period at which this processing is performed is not limited to the above, and may be another period, and it is assumed that information of this period is held in the ROM 62 or the like.

In step S901, the CPU 61 determines whether the predetermined period 1 has elapsed for the wait period. It is assumed that the predetermined period 1 is set to 30 seconds for example, and is held in the ROM 62 or the like. The above value is an example, and another value may be used. If it is determined that the predetermined period 1 has not elapsed for the wait period (NO in step S901) this processing flow ends, and if it is determined that the predetermined period 1 has elapsed (YES in step S901) the processing proceeds to step S902.

In step S902, the CPU 61 determines whether the value of performance maintenance flag A is ON. If the value of performance maintenance flag A is OFF (NO in step S902) the processing proceeds to step S904, and if the value of performance maintenance flag A is ON (YES in step S902) the processing proceeds to step S903.

In step S903 the CPU 61 performs maintenance operation A that is illustrated in FIG. 7A. At this point, only minimum necessary performance maintenance of the printhead 4 is performed. By this, lengthening the life span of the printhead 4 and the purge unit 3 is attempted, and it is possible to suppress a time delay until start of the printing operation to a minimum even if a printing operation is started during the maintenance operation. Subsequently the processing proceeds to step S904.

In step S904, the CPU 61 determines whether a predetermined period 2 has elapsed for the wait period. It is assumed that the predetermined period 2 is set to 10 minutes for example, and is held in the ROM 62 or the like. The above value is an example and another value may be used, but setting is performed such that the predetermined period 1<the predetermined period 2. If it is determined that the predetermined period 2 has not elapsed for the wait period (NO in step S904) this processing flow ends, and if it is determined that the predetermined period 2 has elapsed (YES in step S904) the processing proceeds to step S905.

In step S905, the CPU 61 determines whether the value of performance maintenance flag B is ON. If the value of performance maintenance flag B is OFF (NO in step S905) this processing flow ends, and if the value of performance maintenance flag B is ON (YES in step S905) the processing proceeds to step S906.

In step S906 the CPU 61 performs maintenance operation B that is illustrated in FIG. 7B. At this point a sufficient maintenance operation that is not excessive or insufficient is performed from a state where only a minimum necessary maintenance operation for the printhead 4 has been performed. By this, it is possible to realize performance maintenance of the printhead 4 even if a maintenance operation for when the predetermined period 1 has elapsed for the wait period is only the minimum necessary. In addition, because maintenance operation B omits some of the maintenance operation due to the operation details in maintenance operation A, another contribution is made to lengthening the life span of the printhead 4 and the purge unit 3. After the processing of step S906, this processing flow ends.

(Processing to Decide a Maintenance Operation Before a Scanning Operation)

Figure 10:
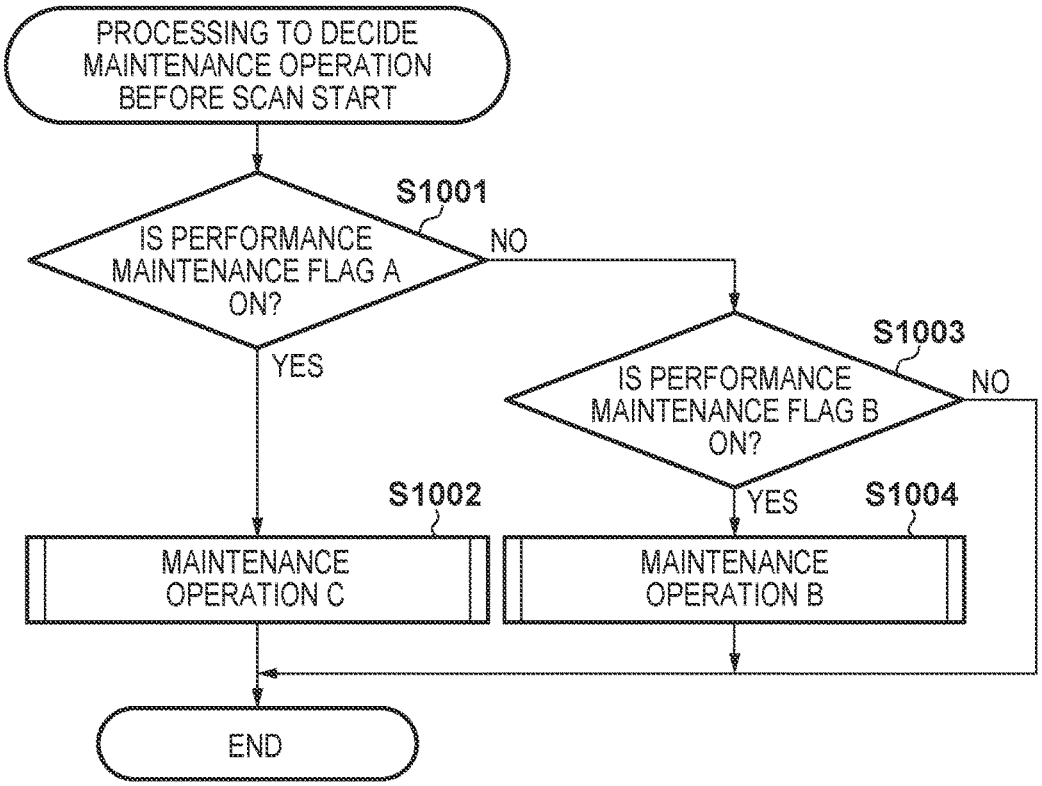
FIG. 10 is a flowchart illustrating a maintenance operation decision before starting image scanning.

FIG. 10 is a flowchart that illustrates control for deciding and performing a maintenance operation for the printhead 4 by the purge unit 3, before the start of image scanning by the scanning unit 5. This processing flow is started when an image scanning instruction is accepted via the operation display unit 14, when a scan job is accepted from the host apparatus 65, or the like.

In step S1001, the CPU 61 determines whether the value of performance maintenance flag A is ON. If the value of performance maintenance flag A is ON (YES in step S1001) the processing proceeds to step S1002, and if the value of performance maintenance flag A is OFF (NO in step S1001) the processing proceeds to step S1003.

In step S1002 the CPU 61 performs maintenance operation C that is illustrated in FIG. 7C. By this, sufficient performance maintenance is performed from a state where a maintenance operation of the printhead 4 has not been performed after a printing operation ends. Subsequently this processing flow ends.

In step S1003, the CPU 61 determines whether the value of performance maintenance flag B is ON. If the value of performance maintenance flag B is ON (YES in step S1003) the processing proceeds to step S1004, and if the value of performance maintenance flag B is OFF (NO in step S1003) this processing flow ends.

In step S1004 the CPU 61 performs maintenance operation B that is illustrated in FIG. 7B. At this point sufficient performance maintenance that is not excessive or insufficient is performed from a state where only a minimum necessary maintenance operation for the printhead 4 has been performed. This processing flow then ends.

After this processing flow is performed, the scanning operation is performed.

By virtue of the present embodiment, a sufficient maintenance operation is performed before starting image scanning, in accordance with flags that express a necessity for a maintenance operation. By this, it is possible to maintain performance of the printhead 4 even if a maintenance operation is not performed during a scanning operation. Therefore, it is possible to suppress a maintenance operation during a scanning operation, and it is possible to prevent deterioration of a scanned image from occurring due to vibration in accordance with operation of the purge unit 3.

In addition, it is possible to suppress excess maintenance operations, attempt to lengthen the life span of the printhead 4 and the purge unit 3, and also suppress a delay until the start of image scanning due to the performance of a maintenance operation to a minimum.

<Second Embodiment>

With reference to the drawings, explanation is given below regarding a second embodiment of the present invention. Note that, because basic portions of the configuration or the like of the printing apparatus are similar to that of the first embodiment, explanation thereof is omitted, and explanation is given for configurations that are different.

In the first embodiment, as illustrated in FIG. 10, an image scanning operation by the scanning unit 5 is performed after a maintenance operation of the printhead 4 is performed in accordance with performance maintenance flag A and performance maintenance flag B. In the second embodiment, when a user uses a copy function, a maintenance operation decided by the method illustrated in FIG. 10 is omitted, and a printing operation and an image scanning operation in accordance with the flowchart illustrated in FIG. 11 are performed.

[Copy Operation]

Figure 11:
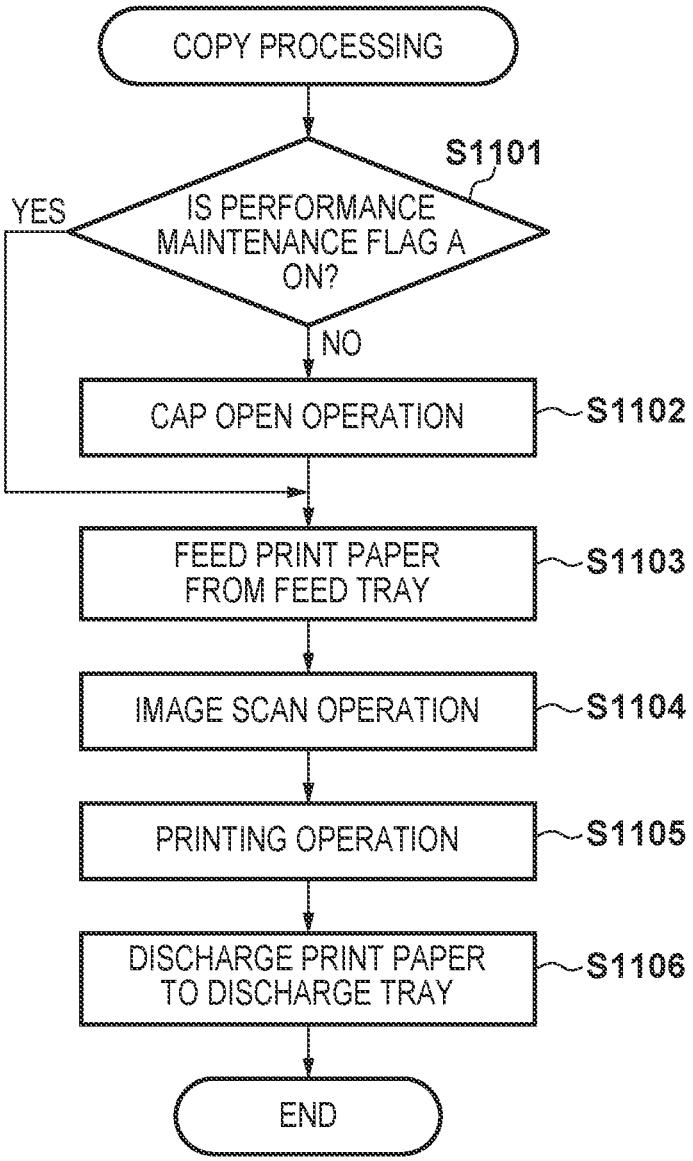
FIG. 11 is a flowchart illustrating control of a copy function according to a second embodiment.

FIG. 11 is a flowchart that illustrates control at a time of using a copy function. In the present embodiment, each processing flow is realized by the CPU 61 of the printing apparatus 1 reading a program provided in the ROM 62 into the RAM 63, and executing it.

Firstly, preparation for a printing operation is performed in accordance with step S1101 through step S1103.

In step S1101, the CPU 61 determines whether the value of performance maintenance flag A is ON. If performance maintenance flag A is OFF (NO in step S1101), it is envisioned that the cap 31 is in the "closed state", and the processing proceeds to step S1102. If performance maintenance flag A is ON (YES in step S1101), it is envisioned that the cap 31 is in the "open state", and the processing proceeds to step S1103, omitting a cap open operation.

In step S1102, the CPU 61, by driving the various motors 69 via the motor driver 68, performs a cap open operation to have the cap 31 enter the "open state". By this, a state where a feed operation of a print paper is possible is entered. Subsequently the processing proceeds to step S1103.

In step S1103, the CPU 61 performs an operation to feed a print paper from the feed tray 11.

In step S1104, the CPU 61 causes an image scanning operation to be performed by the scanning sensor unit 51 with respect to an original placed on the original platen 13.

In step S1105, the CPU 61 causes the printhead 4 to be driven via the head driving circuit 42, and causes a printing operation to be performed.

In step S1106, the CPU 61 causes a print paper to be discharged to the discharge tray 12 by driving the various motors 69 via the motor driver 68. By this, control of the copy function ends. After control of the copy function ends, processing for after the end of a printing operation (FIG. 8) is performed, and a maintenance operation for the printhead 4 is performed in accordance with the flowcharts illustrated in FIG. 9 and FIG. 10.

By virtue of the present embodiment, by omitting a maintenance operation for the printhead 4 when the copy function is used, it is possible to shorten a period until a printing operation starts. By appropriately performing a preliminary discharge operation for the printhead 4 while the cap 31 is in the "open state", it is possible to maintain the performance of the printhead 4. In addition, as illustrated in FIG. 11, by causing the operation timing of the printing unit 2 and the scanning unit 5 to differ, it is possible to prevent deterioration of a scanned image due to vibration in accordance with operation of the printing unit. Note that, when performing image scanning that is not accompanied by a printing operation, a maintenance operation for the printhead 4 may be performed in accordance with the flowchart illustrated in FIG. 10, similarly to in the first embodiment.

<Other Embodiments>

The details of a maintenance operation for the printhead 4 illustrated in the above embodiments, and a method of deciding such are only an example. The details of a maintenance operation before starting a scanning operation, for example, may be decided in accordance with the time required for the scanning operation in addition to an elapsed time from the end of a printing operation. In addition, if a power off operation is performed in the operation display unit 14, a maintenance operation for the printhead 4 may be performed irrespective of a method to decide a maintenance operation in accordance with the wait period of FIG. 9.

In addition, the detail of a maintenance operation may a5 be decided in accordance with a setting in a scanning operation. Furthermore, if a period that is predicted as the time required for a scanning operation is sufficiently short compared to a time interval for periodically performing the processing of FIG. 9 or the predetermined period 1 and the predetermined period 2 used in step S911 or in step S914 of FIG. 9, the process may be configured such that the operation illustrated in FIG. 10 is not performed before performing the scanning operation.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-Ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-151521, filed Aug. 1, 2016, which is hereby incorporated by reference herein in its entirety.

What is claimed is:

1. A printing apparatus comprising:

a scanning unit configured to perform a scanning operation scanning an original document based on a scanning instruction;

a printhead configured to perform a printing operation;

a maintenance unit that can perform a plurality of maintenance operations for the printhead;

a storage unit configured to store maintenance information indicating which of the plurality of maintenance operations was performed;

a timer configured to measure an elapsed time from a previous printing operation; and a control unit configured to control the maintenance unit to perform a maintenance operation that is determined based on the stored maintenance information if the elapsed time exceeds a threshold, wherein, in a case where the scanning instruction is received, the control unit controls the maintenance unit to perform the maintenance operation that is determined based on the stored maintenance information before the scanning operation, even if the elapsed time does not exceed the threshold.

2. The printing apparatus according to claim 1, wherein, in a case where the elapsed time exceeds a first threshold, the control unit controls the maintenance unit to perform a first maintenance operation, and wherein, in a case where the elapsed time exceeds a second threshold which is longer than the first threshold, the control unit controls the maintenance unit to perform a second maintenance operation, which is stronger than the first maintenance operation.

3. The printing apparatus according to claim 2, wherein, in a case where the scanning instruction is received and the stored maintenance information indicates the second maintenance operation was performed, the the control unit does not execute a maintenance operation.

4. The printing apparatus according to claim 2, wherein, in a case where the scanning instruction is received and the stored maintenance information indicates the first maintenance operation pattern was performed and the second maintenance operation was not performed, the control unit controls the maintenance unit to perform the second maintenance operation regardless of the elapsed time measured by the timer.

5. The printing apparatus according to claim 2, wherein, in a case where the scanning instruction is received and the stored maintenance information indicates neither the first maintenance operation nor the second maintenance operation was performed, the control unit controls the maintenance unit to perform a third maintenance operation, which is stronger than the second maintenance operation, regardless of the elapsed time measured by the timer.

6. The printing apparatus according to claim 2, wherein the plurality of maintenance operations comprises a combination of one or more of a wiping operation, a preliminary discharge operation, an idle suction operation, and a capping operation.

7. The printing apparatus according to claim 6, further comprising:

a count unit configured to count a number of ink dots discharged from the printhead, wherein the control unit decides an operation to be performed in the first maintenance operation in accordance with the number of ink dots counted by the count unit.

8. The printing apparatus according to claim 7, wherein the count unit counts a number of dots discharged by a preliminary discharge operation, and wherein the control unit controls the maintenance unit to perform the idle suction operation in the first maintenance operation, if the number of dots discharged by the preliminary discharge operation exceeds a first predetermined number.

9. The printing apparatus according to claim 7, wherein the count unit counts a number of dots discharged by a preliminary discharge operation and the printing operation, and wherein the control unit controls the maintenance unit to perform the wiping operation and the preliminary discharge operation in the first maintenance operation, if the number of dots discharged by the preliminary discharge operation and the printing operation exceeds a second predetermined number.

10. The printing apparatus according to claim 7, wherein the control unit controls the maintenance unit to perform the wiping operation and the preliminary discharge operation in the second maintenance operation if the wiping operation and the preliminary discharge operation were not performed in the first maintenance operation.

11. The printing apparatus according to claim 2, wherein the scanning unit is configured to perform a copy operation based on a copying instruction, and wherein, in a case where the copying instruction is received, the control unit does not to execute the maintenance operation before the copy operation by the scanning unit.

12. A method of controlling a printing apparatus provided with a scanning unit for performing a scanning operation scanning an original document based on a scanning instruction, and a printhead for performing a printing operation, the method comprising:

performing a maintenance operation of a plurality of maintenance operations for the printhead that includes a plurality of operation patterns;

storing information indicating which of the plurality of maintenance operations was performed when the maintenance operation was performed;

measuring an elapsed time from a previous printing operation; and performing a second maintenance operation of the plurality of maintenance operations that is determined based on the information, if the elapsed time exceeds a threshold, wherein, in a case where the scanning instruction is received, the second maintenance operation is performed before the scanning operation, even if the elapsed time does not exceed the threshold.

13. A non-transitory computer readable medium storing a program for causing a computer provided with a scanning unit for performing a scanning operation scanning an original document based on a scanning instruction and a printhead for performing a printing operation to function as:

a maintenance unit that can perform a plurality of maintenance operations for the printhead;

a storage unit configured to store maintenance information indicating which of the plurality of maintenance operations was performed;

a timer configured to measure an elapsed time from a previous printing operation; and a control unit configured to control the maintenance unit to perform a maintenance operation that is determined based on the stored maintenance information if the elapsed time exceeds a threshold, wherein, in a case where the scanning instruction is received, the control unit controls the maintenance unit to perform the maintenance operation that is determined based on the stored maintenance information before the scanning operation, even if the elapsed time does not exceed the threshold.

* * * * *